United States Patent [19]

Seres et al.

[11] 4,124,902

[45] Nov. 14, 1978

[54] MOUNTING ASSEMBLY CONNECTING A FACE SHIELD TO A SAFETY HAT

[75] Inventors: Robert J. Seres, Allison Park; James J. Summers, Bethel Park, both of Pa.

[73] Assignee: Mine Safety Appliances Company, Pittsburgh, Pa.

[21] Appl. No.: 847,125

[22] Filed: Oct. 31, 1977

[51] Int. Cl.[2] ..... A41D 13/00; A44B 21/00

[52] U.S. Cl. ..... 2/10; 2/209

[58] Field of Search ..... 2/209, 10; 179/156 R; 403/348

[56] References Cited

U.S. PATENT DOCUMENTS

| | | | |
|---|---|---|---|
| 2,801,420 | 8/1957 | Malcom, Jr. | 2/10 X |
| 3,332,086 | 7/1967 | Simpson et al. | 2/10 X |
| 3,430,262 | 3/1969 | Raschke | 2/10 X |
| 3,797,042 | 3/1974 | Gager, Jr. | 2/10 |

*Primary Examiner*—Werner H. Schroeder
*Assistant Examiner*—Andrew M. Falik
*Attorney, Agent, or Firm*—Brown, Flick & Peckham

[57] ABSTRACT

A mounting assembly for supporting a face shield from a safety hat includes a pair of brackets for attachment to the opposite sides of the hat, each of the brackets having between its inner and outer sides a downwardly extending recess therein, in which there is a vertically movable slide normally held in its upper position. The outer side of each bracket has a passage extending outwardly therethrough from the slide recess, with the lower wall of the passage provided with an opening containing a prong projecting from the slide. The prong has a projection on top normally extending into the passage and forming a shoulder facing the slide but spaced from it. In that space the head of a bolt normally is locked. The bolt extends out of the passage and through a hole in an arm, with a nut on the outer end of the bolt. The opposite sides of a face shield are adjustable lengthwise of the two arms. The bolts are releasable from the brackets when the slides are depressed.

7 Claims, 8 Drawing Figures

MOUNTING ASSEMBLY CONNECTING A FACE SHIELD TO A SAFETY HAT

U.S. Pat. No. 3,898,700 shows a pair of brackets for attachment to a safety hat in order to support ear protectors and a face shield. This is a perfectly satisfactory arrangement in many situations, but in others it may have the disadvantage that a band is required for encircling the hat to support the brackets, and that the face shield can only be swung up and down and not moved in any other direction relative to the supporting brackets.

It is among the objects of this invention to provide a mounting assembly for supporting a face shield from a safety hat, in which supporting brackets are connected directly to the hat, in which the face shield can be adjusted forward and backward and up and down relative to the brackets, and by which ear protectors also can be supported with or without the face shield.

The preferred embodiment of the invention is illustrated in the accompanying drawings, in which FIG. 1 is a fragmentary side view of a safety hat and attached face shield;

Figure 1:
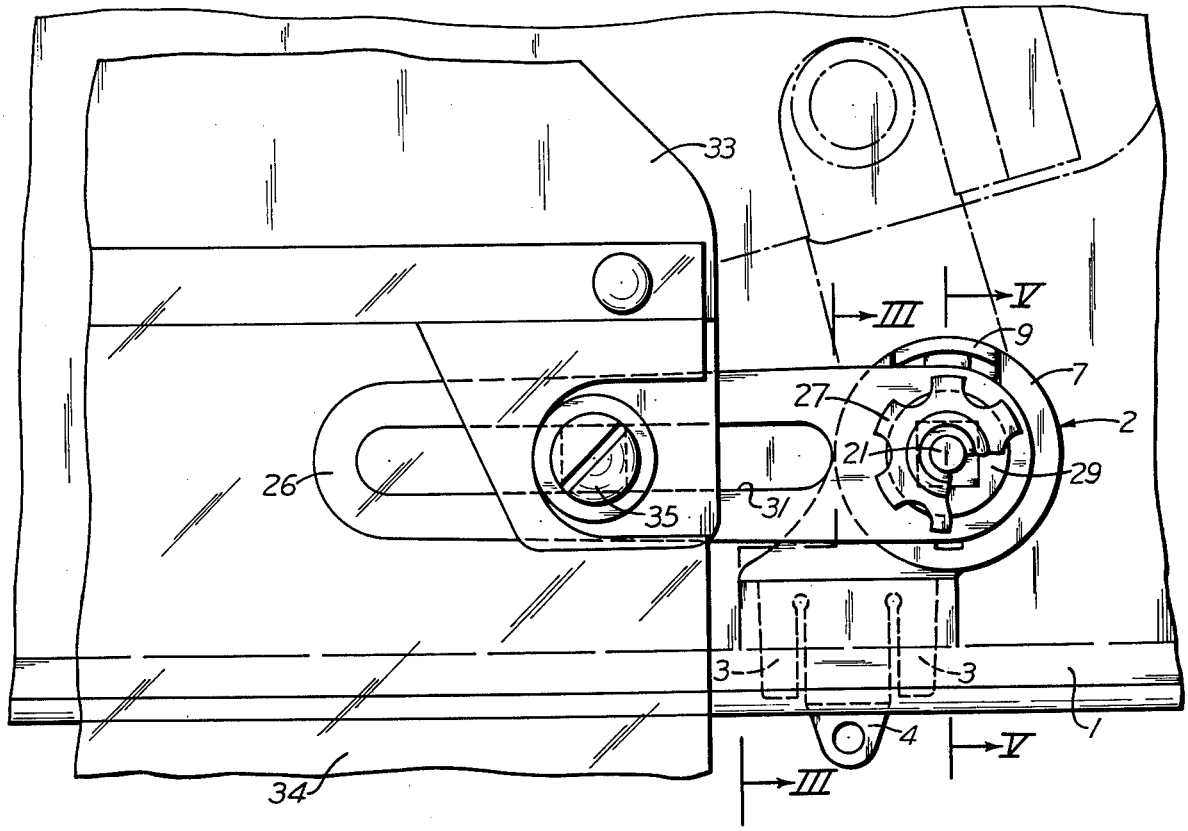

Referring to FIGS. 1 to 4 of the drawings, a pair of brackets is provided for attachment to a safety hat 1. Only the bracket 2 at the left-hand side of the helmet is shown. Preferably, the brackets are detachably connected to the hat by providing them with downwardly extending tongues for insertion in vertical slots in the opposite sides of the hat where the brim meets the crown. Thus, each bracket may be provided with three tongues, the outer two 3 of which are rigid and fit in the slot while the center tongue 4 is flexible and provided near its lower end with a shoulder 5 for snapping under the brim when the bracket is inserted in the slot, whereby to removably lock the bracket to the hat.

Figure 5:
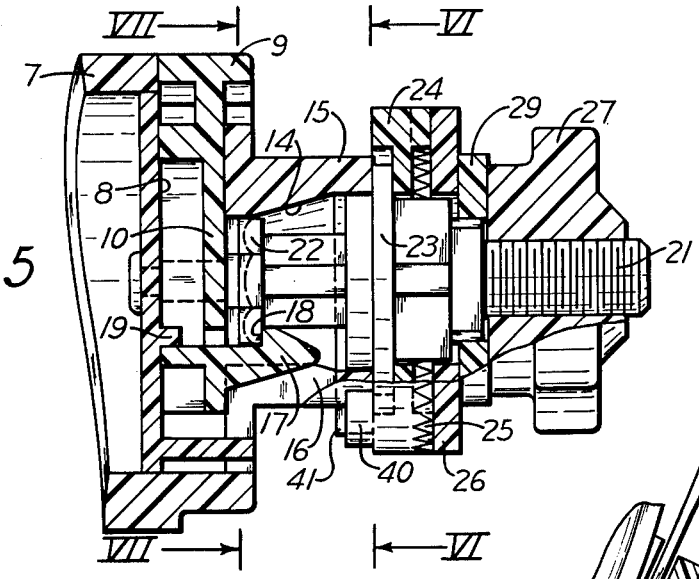
FIG. 5 is an enlarged vertical section taken on the line V—V of FIG. 1.
Figure 6:
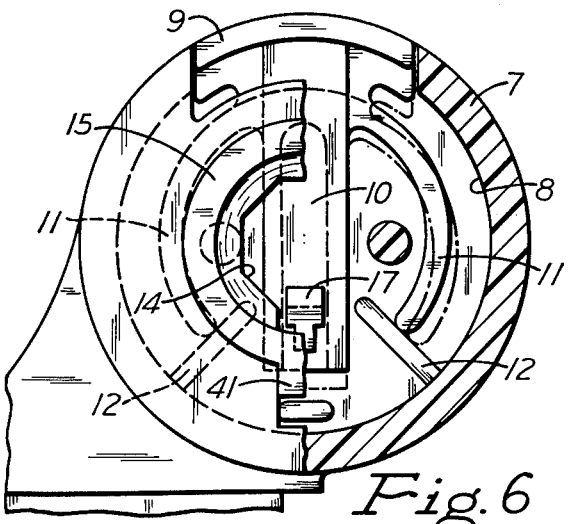
FIG. 6 is a side view, partly in section, taken on the line VI—VI of FIG. 5 of the left-hand element.

Above the tongues, each bracket has a circular body 7 in which, as shown in FIGS. 5 and 6, there is a recess 8 that extends downwardly between the inner and outer sides of the bracket from an opening at the top of the recess. Disposed in this recess for vertical movement therein is a slide, the upper end 9 of which fills the opening at the top of the recess. Extending downwardly is a central stem 10, and on opposite sides of this stem are curved downwardly extending leaf springs 11. The slide and the springs preferably are made of a plastic, with the upper ends of the springs integral with the slide. The lower ends of the springs rest on a pair of downwardly diverging cam surfaces 12 inside the recess. Consequently, when the slide is depressed, the lower ends of the springs will slide down the cam surfaces and thereby be spread apart, as indicated in dotted lines in FIG. 6. When the slide is released, the tendency of the lower ends of the springs to move back toward each other will cause them to slide up the cam surfaces and thereby elevate the slide again.

The outer side of each bracket is provided with a passage 14 extending outwardly through it from its recess. The axis of this passage is substantially radial of the hat. A cylindrical flange 15 projects outwardly around this passage. The lower wall of the passage has an opening 16 in it, into which projects a prong 17 extending outwardly from the lower end of the slide stem. The opening that receives the prong allows it to be moved down with the slide. The outer end of the prong is provided on top with a projection that normally extends above the bottom wall of passage 14 and forms a shoulder 18 facing the slide but spaced from it. The inner end of the prong projects beneath a stop 19 on the inner wall of recess 8, to hold the slide in the recess.

Disposed in the bracket passage is one end of a bolt 21 provided with a head 22 that normally is locked in the bracket passage between the prong shoulder 19 and the slide. The head is non-circular and the portion of the passage in which the head is located conforms to it so that the bolt cannot be turned in the passage. The bolt extends outwardly from the passage and is provided at the outer end of the cylindrical flange 15 with an encircling collar 23 that bears against a clutch ring 24, which has circumferentially spaced radial teeth in its outer surface. These teeth register with corresponding teeth 25 encircling a hole in one end of an arm 26. The bolt extends out through the arm and carries a nut 27 on its outer end, which presses a washer 29 against the arm and holds the teeth of the clutch ring and the arm together.

Figure 2:
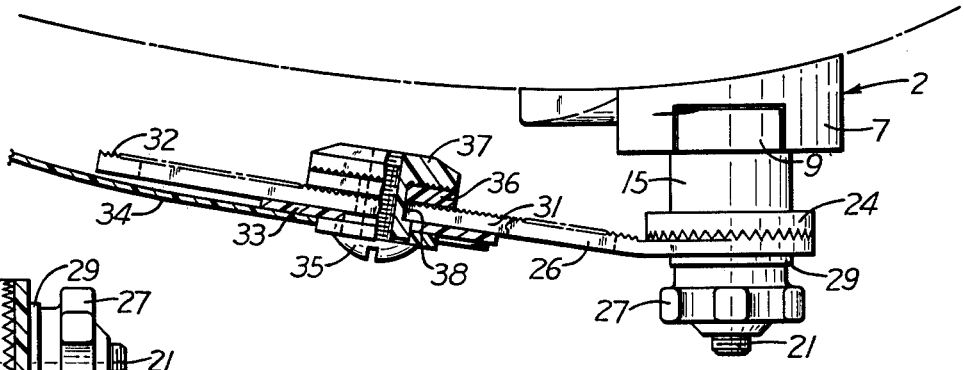
FIG. 2 is a plan view, partly in horizontal section, of the mounting assembly between the shield and hat.
Figure 3:
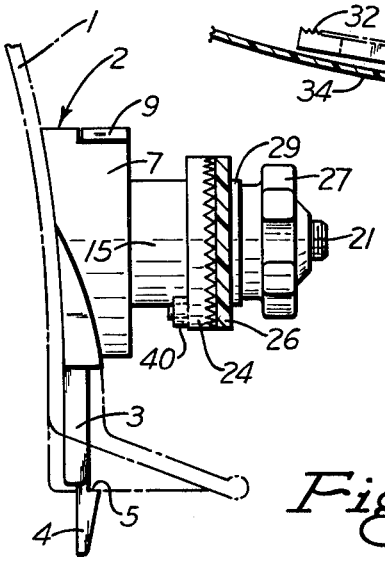
FIG. 3 is a vertical section taken on the line III—III of FIG. 1.
Figure 4:
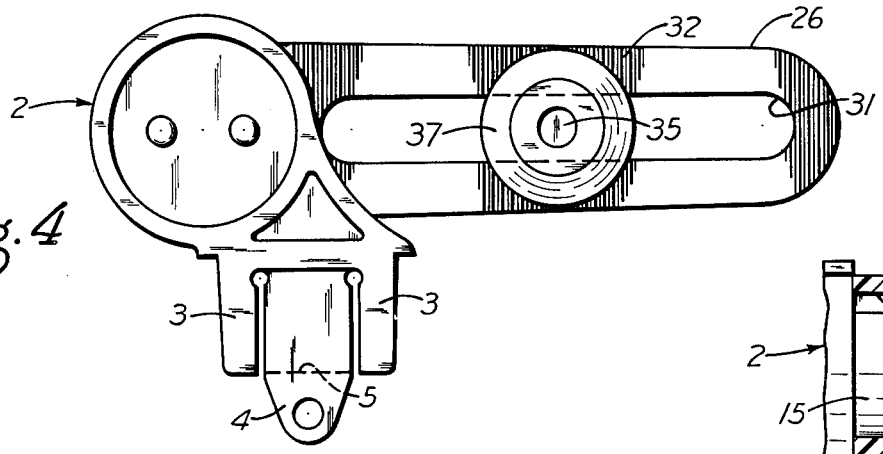
FIG. 4 is a view of the inner side of the mounting assembly.

The two arms, one on each side of the hat, extend forward from brackets 2 and each is provided with a longitudinal slot 31 and preferably with vertical teeth 32 along its inner surface above and below its slot as shown in FIG. 4. A face shield, consisting of a stiff supporting member 33 (FIG. 1) and a laterally curved transparent plastic sheet 34 suspended from the lower edge of that member, is provided at each side near its top with a square hole through which a screw 35 extends. The hole is in a depending extendsion of one end of the supporting member. As shown in FIG. 2, the screw also extends through the adjoining arm slot and a resilient washer 36 and into a circular nut 37 that may be provided with teeth engaging the washer. The nut has an integral hub 38 that encircles the screw. The portion of this hub that extends through the arm is round, but the outer end is square and fits in the square hole in the shield. The tightened screws hold the shield at any desired angle to the arms and also at any desired point along the arms.

Figure 7:
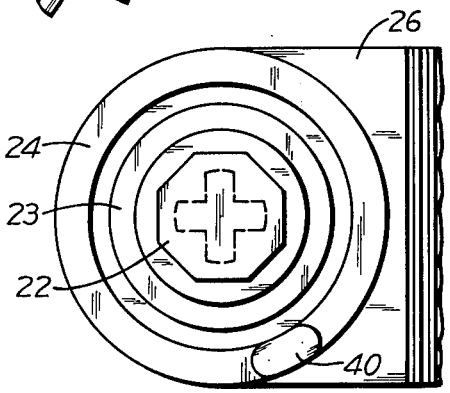
FIG. 7 is a side view taken on the line VII—VII of FIG. 5 of the right-hand element.

To change the inclination of the arms relative to the brackets, the nuts 27 on the bracket bolts are loosened sufficiently to permit the front or outer ends of the arms to be raised or lowered. Then the nuts are tightened again. To help prevent the weight of the shield from swinging the arms downwardly, the clutch ring 24 can be provided with a lug 40 (FIGS. 5 and 7) that extends inwardly across the front of a lug 41 (FIGS. 5 and 6) projecting downwardly from the outer end of flange 15 of the bracket. Engagement of one side of the ring lug with one side of the flange lug prevents the clutch ring from turning in one direction.

In addition to supporting arms 26 for the face shield, brackets 2 are formed for supporting ear protectors.

Figure 8:
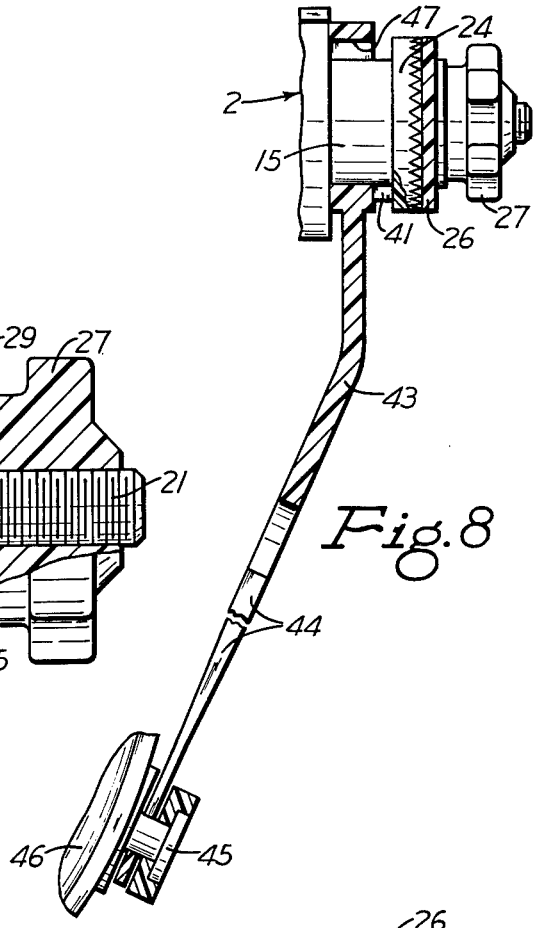
FIG. 8 is a fragmentary side view, partly in vertical section, showing an ear protector suspended from part of the assembly.

Accordingly, the upper ends of a pair of spring arms are provided with holes through which the bracket flanges 15 extend. As shown in FIG. 8, each of these arms 43 is provided with a longitudinal slot 44, in which a headed pin 45 projecting from an ear cover 46 is slidably and rotatably mounted. The arms can be rotated on the flanges between downwardly extending positions and positions above the brim of the hat. The thickness of the upper portion of each spring arm is less than the length of the flange on which it is mounted, so that the flange lug 41 can overlie and engage the outer surface of the arm and thereby lock it in place even when the clutch ring 24 and arm 26 are not present, such as when the face shield is not in use.

In order to be able to apply the spring arm to the flange and also remove it therefrom when desired, the wall of the hole through the spring arm is provided with a radial notch 47. This notch is located at the top of the hole while the arm is extending straight down from the bracket. By rotating the arm about 180° around the bracket flange in order to align the notch with flange lug 41, the arm can be slipped outwardly past the lug and removed from the flange in the manner disclosed in U.S. Pat. No. 3,898,700. This presupposes that the slide has first been depressed to release bolt 21 from the bracket if the bolt was not already absent. To reconnect the bolt and bracket all that is necessary is to insert the bolt head in the bracket passage and push it to cause it to depress prong 17 until the bolt head slips behind shoulder 18, which will then snap up and lock the bolt in place.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A mounting assembly for supporting a face shield from a safety hat, said assembly comprising a pair of brackets for attachment to the opposite sides of a hat, each of said brackets having a downwardly extending recess therein between its inner and outer sides, a slide disposed in each recess for vertical movement therein, resilient means in said recess normally holding the slide in its upper position, the outer side of each bracket being provided with a passage extending outwardly therethrough from its recess, the lower wall of the passage having an opening therein, a prong projecting outwardly from the slide into said opening and having a projection on top normally extending above said lower wall and forming a shoulder facing but spaced from the slide, a bolt having a head normally locked in said passage between said shoulder and slide, the bolt extending out of the passage, an arm with a hole through one end receiving the bolt, a nut on the outer end of the bolt for holding the arm on the bolt, and means for clamping opposite sides of a face shield to the arms, said bolts being releasable from the brackets when said slides are depressed.

2. A mounting assembly according to claim 1, in which the top of said prong projection slopes upwardly toward said shoulder, whereby said bolt head can be snapped into the bracket.

3. A mounting assembly according to claim 1, including a clutch ring rotatable on each bolt, collars on the bolts engaging the bracket sides of said rings, the other sides of the rings having radial teeth, and said arms having radial teeth around said holes meshing with the ring teeth, said nuts pressing said clutch rings against said bolt collars.

4. A mounting assembly according to claim 3, each of said brackets having a cylindrical flange projecting outwardly around its bolt-receiving passage, and a retaining lug projecting radially from the outer end portion of each cylindrical flange, and each clutch ring having a lug projecting toward the adjacent bracket and across the side of said retaining lug.

5. A mounting assembly according to claim 1, in which each of said arms is provided with a longitudinal slot, the bracket side of the arm is provided with teeth beside the arm slot, and said clamping means include a resilient washer engaging said teeth, a nut having a head engaging the washer and having a hub extending through the washer and arm slot, and a screw threaded in said hub.

6. A mounting assembly according to claim 1, in which said resilient means are leaf springs joined at their upper ends to said slide and extending downwardly on both sides of it, and said bracket includes downwardly diverging cam surfaces in said recess engaged by the lower ends of said springs, whereby when the slide is depressed the lower ends of the springs will be forced farther apart but will move back toward each other to raise the slide when it is released.

7. A mounting assembly according to claim 1, in which said brackets are provided with downwardly extending tongues for insertion in vertical slots in the opposite sides of a safety hat.

* * * * *